US009085987B2

(12) United States Patent
Hada

(10) Patent No.: US 9,085,987 B2
(45) Date of Patent: Jul. 21, 2015

(54) TURBINE BLADE AND GAS TURBINE

(75) Inventor: Satoshi Hada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 748 days.

(21) Appl. No.: 13/307,675

(22) Filed: Nov. 30, 2011

(65) Prior Publication Data

US 2012/0263603 A1 Oct. 18, 2012

(30) Foreign Application Priority Data

Apr. 14, 2011 (JP) ..... 2011-089911

(51) Int. Cl.
*F01D 5/18* (2006.01)

(52) U.S. Cl.
CPC ..... *F01D 5/187* (2013.01); *F05D 2240/81* (2013.01); *F05D 2260/202* (2013.01)

(58) Field of Classification Search
CPC ..... F01D 5/18; F01D 5/181; F01D 5/187; F05D 2240/81; F05D 2260/20; F05D 2260/202
USPC ..... 415/115; 416/95, 96 R, 97 R, 193 R, 416/193 A
See application file for complete search history.

(56) References Cited

U.S. PATENT DOCUMENTS 5,122,033 A * 6/1992 Paul ..... 416/96 R
5,340,278 A * 8/1994 Magowan ..... 416/96 R
5,382,135 A * 1/1995 Green ..... 416/97 R
7,097,417 B2 * 8/2006 Liang ..... 415/115
7,621,718 B1 * 11/2009 Liang ..... 415/115
7,841,828 B2 * 11/2010 Liang ..... 415/191
7,927,073 B2 * 4/2011 Scott et al. ..... 416/97 R
2006/0127220 A1 * 6/2006 Lee ..... 416/97 R
2007/0020100 A1 1/2007 Beeck et al.
2009/0202339 A1 * 8/2009 Torii et al. ..... 415/115
2011/0223005 A1 * 9/2011 Lee et al. ..... 415/115
2012/0107135 A1 * 5/2012 Harris et al. ..... 416/97 R

FOREIGN PATENT DOCUMENTS

CN 101473107 A 7/2009
JP 09-280002 A 10/1997

(Continued)

OTHER PUBLICATIONS

International Search Report of PCT/JP2011/077466, date of mailing Jan. 17, 2012.
Korean Notice of Allowance dated Mar. 27, 2013, issued in corresponding Korean Patent Application No. 10-2012-7028442; w/English translation (3 pages).

(Continued)

*Primary Examiner* — Nathaniel Wiehe
*Assistant Examiner* — Kayla McCaffrey
(74) *Attorney, Agent, or Firm* — Westerman, Hattori, Daniels & Adrian, LLP

(57) ABSTRACT

A turbine blade includes: a base portion fixed to a rotor; a platform that is fixed to the base portion and includes a cooling flow channel; a blade shape portion that extends from the platform to an outer side in a radial direction; and a fillet portion provided in a joint surface between the blade shape portion and the platform, and the turbine blade further includes: a main pipe that is branched off from the cooling flow channel and has an opening at a side end portion of the platform; and a branch pipe that is branched off from the main pipe, extends along the fillet portion so as to be close thereto on an inner side in the radial direction, and includes a film cooling hole opened on a surface of the platform.

5 Claims, 5 Drawing Sheets

(56) References Cited

FOREIGN PATENT DOCUMENTS

| | | | |
|---|---|---|---|
| JP | 2006-170198 | A | 6/2006 |
| JP | 2008-202547 | A | 9/2008 |
| JP | 2009-503331 | A | 1/2009 |
| KR | 10-2006-0128284 | A | 12/2006 |
| WO | 2007-012590 | A1 | 2/2007 |
| WO | 2010/086402 | A2 | 8/2010 |
| WO | 2011/115731 | A1 | 9/2011 |

OTHER PUBLICATIONS

Japanese Decision to Grant Patent mailed May 14, 2013, issued in corresponding Japanese Patent Application No. 2012-549170; w/partial English translation (4 pages).

Chinese Office Action dated Mar. 5, 2014, issued in corresponding Chinese Patent Application No. 201180020919.1 (13 pages).

Extended European Search Report dated Jul. 31, 2014, issued in corresponding European Patent Application No. 11863523.4 (5 pages).

* cited by examiner

TURBINE BLADE AND GAS TURBINE

CROSS-REFERENCE TO RELATED APPLICATIONS

This application is based on Japanese Patent Application No. 2011-089911, the contents of which are incorporated herein by reference.

TECHNICAL FIELD

The present invention relates to a turbine blade that is applied to a gas turbine and concerns cooling of a fillet and to a gas turbine.

BACKGROUND ART

A gas turbine is an apparatus that converts thermal energy of high-temperature combustion gas into rotational energy and takes out the converted energy as electric power, and turbine blades incorporated in the gas turbine are always used in the high-temperature combustion gas. Accordingly, the turbine blades each include cooling flow channels such as serpentine flow channels, and take in cooling air from the outside to thereby cool a blade shape portion thereof. In particular, a fillet portion forming a joint surface between the blade shape portion and the platform of each turbine blade has a thicker wall and thus is difficult to cool. Hence, the wall temperature of the fillet portion is relatively high, and the fillet portion tends to be subjected to a high thermal stress, in terms of a thermal load and a blade structure. A thermal stress tends to increase particularly in the fillet portion near the leading edge and a portion on the pressure side (positive pressure side) of the blade shape portion near the leading edge. In order to solve this problem, various methods of cooling the fillet portion by convection cooling have been proposed as means for cooling the fillet portion of the turbine blade.

Japanese Unexamined Patent Application, Publication No. 2006-170198 discloses the following solution. A branch pipe of cooling air is drawn from a cooling air supply channel provided in a blade shape portion, a film cooling hole is opened so as to pass through a fillet portion, and the cooling air is blown out from the film cooling hole, to thereby cool the fillet portion.

Japanese Unexamined Patent Application, Publication No. 2008-202547 discloses the following cooling means. A plurality of cooling air pipes are branched off from a cooling air supply channel of a blade shape portion, are extended below a fillet, and are connected to a platform surface. Cooling air passes through the cooling air pipes to be blown out from a film hole on the platform surface.

CITATION LIST

Patent Literature

Japanese Unexamined Patent Application, Publication No. 2006-170198

Japanese Unexamined Patent Application, Publication No. 2008-202547

SUMMARY OF INVENTION

Technical Problem

Unfortunately, a high thermal stress generally occurs near the fillet portion and in the platform surface on which a large thermal load is put. Hence, stress concentration occurs around a hole by hole processing, so that the crack on the platform surface occurs due to the high thermal stress. Accordingly, there is a problem in forming hole on the fillet portion, the blade surface, and the platform surface, in terms of a high thermal stress to be subjected.

In addition, in the cooling structure disclosed in Japanese Unexamined Patent Application, Publication No. 2008-202547, the fillet portion is away from the branch pipes of the cooling flow channel, and hence cooling of the fillet portion is insufficient.

The present invention has been made in view of the above-mentioned problems, and therefore has an object to provide a cooling structure for a turbine blade, in which: hole processing is not applied on a fillet portion, a blade surface, and a platform surface to which a high thermal stress occurs; and cooling air that has cooled the fillet portion by convection is discharged from a platform surface to which a low thermal stress is applied.

Solution to Problem

In order to solve the above-mentioned problems, the present invention adopts the following solutions.

A turbine blade according to a first aspect of the present invention includes: a base portion fixed to a rotor; a platform that is fixed to the base portion and includes a cooling flow channel; a blade shape portion that extends from the platform to an outer side in a radial direction; and a fillet portion provided in a joint surface between the blade shape portion and the platform, and the turbine blade further includes: a main pipe that is branched off from the cooling flow channel and has an opening at a side end portion of the platform; and a branch pipe that is branched off from the main pipe, extends along the fillet portion so as to be close to the fillet portion on an inner side in the radial direction, and includes a film cooling hole opened on a surface of the platform.

According to the first aspect, the main pipe is branched off from the cooling flow channel in the blade shape portion of the turbine blade, and the branch pipe is further branched off from the main pipe, whereby the branch pipe can be arranged inside of the fillet portion so as to be close thereto. Accordingly, the fillet portion is cooled by convection from the inside thereof, and a thermal stress applied to the fillet portion is reduced. In addition, forming a cooling hole on the platform surface which is subjected to a high thermal stress is not required, and hence fatigue crack due to stress concentration around the hole can be avoided, leading to enhanced reliability of the turbine blade.

In the first aspect, it is desirable that the cooling flow channel be provided at a position closest to a leading edge.

According to the first aspect, the cooling flow channel from which the main pipe is drawn is located closest to the leading edge. Hence, the fillet portion near the leading edge which is subjected to a high thermal stress can be cooled.

In the first aspect, it is desirable that, in sectional plan view taken in a radial direction of the blade shape portion, the branch pipe is provided so as to pass through inside a sectional plane of the fillet portion.

According to the configuration described above, the branch pipe passes just below the fillet portion so as to be close thereto. Hence, the fillet portion is cooled by convection from just below, and the lower surface of the fillet portion can be sufficiently cooled.

In the configuration described above, it is desirable that the branch pipe be provided parallel to a tangent line that externally touches an inner wall of the cooling flow channel on a pressure side of the blade shape portion and internally touches an outer edge of the fillet portion on the pressure side of the blade shape portion.

According to the configuration described above, the branch pipe is arranged parallel to the tangent line that externally touches the pressure-side inner wall of the cooling flow channel and internally touches the outer edge of the fillet portion. Accordingly, the branch pipe can be arranged closest to the fillet portion, and hence the fillet portion can be cooled in the widest range.

In the configuration described above, it is desirable that, in the sectional plan view taken in the radial direction of the blade shape portion, the branch pipe include the film cooling hole that is opened at a middle point or closer to the main pipe with respect to the middle point, the middle point being between: an intersection point between an extended line of the branch pipe and the outer edge of the fillet portion; and a connection port with the main pipe.

According to the configuration described above, in the sectional plan view of the blade shape portion, the film cooling hole of the branch pipe can be located at the middle point or closer to the main pipe with respect to the middle point, the middle point being between: the intersection point between the extended line of the branch pipe and the fillet line; and the connection port with the main pipe. Hence, hole processing on the branch pipe is facilitated.

In the configuration described above, it is desirable that: the branch pipe include a plurality of branch pipes; and, in the sectional plan view taken internally in the radial direction of the blade shape portion, the film cooling holes of the branch pipes be sequentially brought closer to the main pipe with increasing distance from a center of the blade shape portion.

According to the configuration described above, in the sectional plan view of the blade shape portion, the branch pipes respectively include the film cooling holes that are opened at positions closer to the main pipe with increasing distance from the center, with reference to the branch pipe located closest to the center of the blade shape portion. Hence, even the branch pipes away from the center of the blade shape portion can be arranged close to the fillet portion near the leading edge, and cooling of the fillet portion near the leading edge can be improved.

It is desirable that a gas turbine according to a second aspect of the present invention include the above-mentioned turbine blade.

According to the second aspect, the reliability of the blade is enhanced, the gas turbine can be operated for a longer time, and the reliability of the entire gas turbine is enhanced.

Advantageous Effects of Invention

According to the present invention described above, the fillet portion to which a high thermal stress is applied can be cooled without opening a cooling hole in a region of the turbine blade to which a high thermal stress is applied. Hence, the reliability of the blade is enhanced, and the gas turbine can be operated for a longer time.

DESCRIPTION OF EMBODIMENTS

First Embodiment

Hereinafter, a turbine blade and a gas turbine according to a first embodiment are described with reference to FIG. 1 to FIG. 3.

Figure 1:
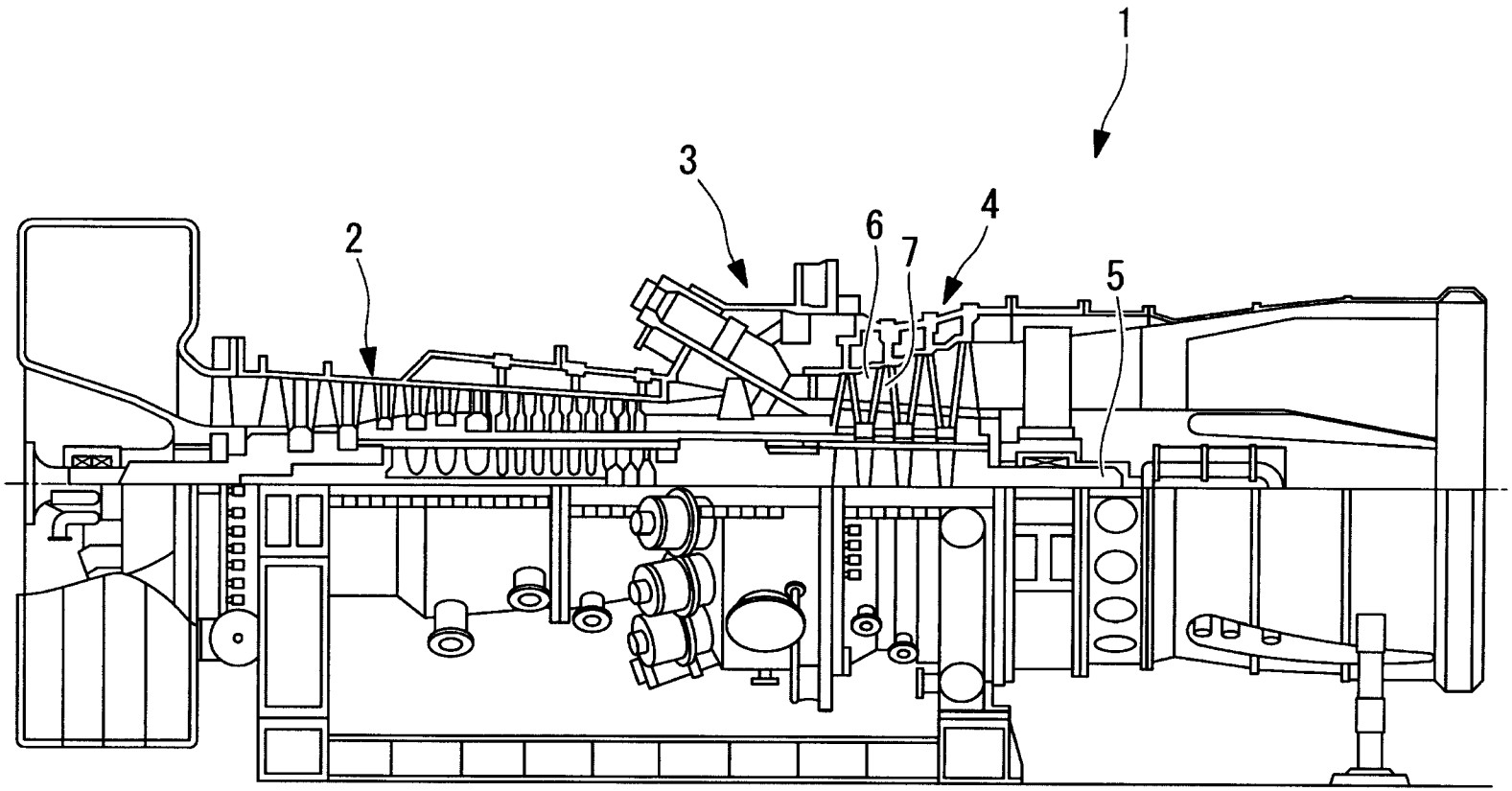
FIG. 1 illustrates an example overall configuration view of a gas turbine.

FIG. 1 illustrates an overall configuration view of a gas turbine. A gas turbine 1 includes: a compressor 2 that compresses combustion air; a combustor 3 that combusts the compressed air fed from the compressor 2 by jetting a fuel thereto and generates combustion gas; a turbine unit 4 that is provided on the downstream side in the flow direction of the combustion gas fed from the combustor and is driven with the combustion gas fed from the combustor; and a rotor 5 that integrally connects the compressor 2, the turbine unit 4, and a power generator (not illustrated).

The turbine unit 4 supplies the combustion gas generated by the combustor 3 to turbine vanes 6 and turbine blades 7, and the turbine blades 7 are rotated around the rotor 5, whereby rotational energy is converted into electric power. The turbine vanes 6 and the turbine blades 7 are alternately arranged from the upstream side to the downstream side in the flow direction of the combustion gas. In addition, the turbine blades 7 are provided in the circumferential direction of the rotor 5, and are rotated integrally with the rotor 5.

Figure 2:
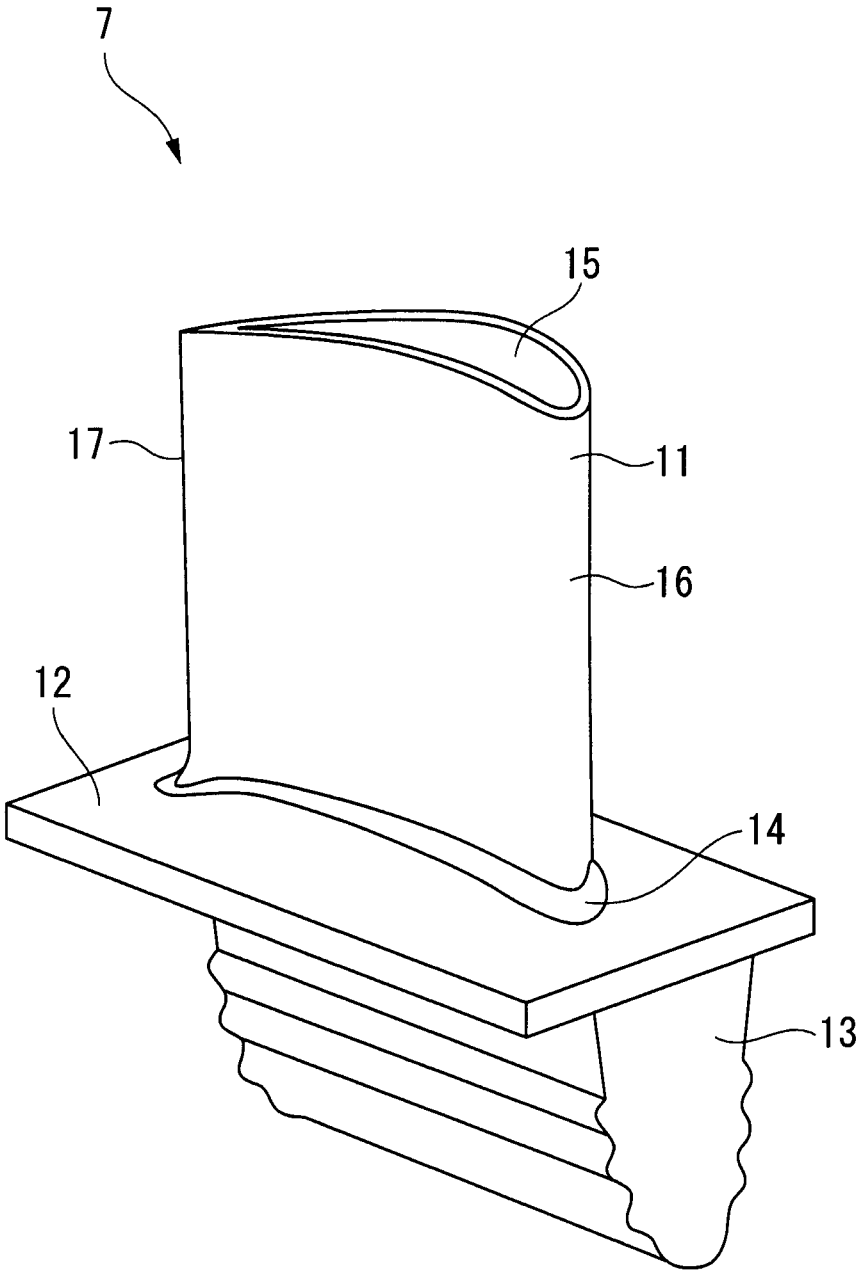
FIG. 2 illustrates a perspective view of a turbine blade.

FIG. 2 illustrates an external view of the turbine blade. Each turbine blade 7 includes: a base portion 13 fixed to the rotor; a platform 12 that is fixed to the base portion 13 and includes cooling flow channels; and a blade shape portion 11 that extends from the platform 12 to an outer side in the radial direction and includes cooling flow channels. The blade shape portion 11, the platform 12, and the base portion 13 are integrally formed by molding. A fillet portion 14 forming the joint surface between the platform 12 and the blade shape portion 11 is formed in the entire periphery of the blade shape portion so as to have a smoothly curved surface having such a given R (radius of curvature) that can avoid stress concentration. The boundary between the fillet portion 14 and a surface 12*a* of the platform 12 defines an outer edge 14*a* of the fillet portion.

An example cross-sectional structure of the turbine blade according to the present embodiment is described with reference to FIG. 3 and FIG. 4(*a*) to FIG. 4(*c*). FIG. 3 illustrates a sectional plan view taken in the radial direction of the turbine blade. FIG. 4(*a*) illustrates a cross-section A-A of FIG. 3, FIG. 4(*b*) illustrates a cross-section B-B of FIG. 3, and FIG. 4(*c*) illustrates an enlarged view around a leading edge of FIG. 3.

In order to cool the blade shape portion 11, the turbine blade 7 takes in cooling air CA from cooling flow channels (not illustrated) on the rotor side. The cooling air CA passes through a plurality of cooling flow channels (not illustrated) provided in the base portion 13, and then is supplied to the cooling flow channels provided in the blade shape portion. A general cooling flow channel of the turbine blade is formed of: a single cooling flow channel that is located closest to the leading edge and extends from the base portion side to a blade top portion of the blade shape portion; and a serpentine cooling flow channel including cooling flow channels in a plurality of flow systems.

In the serpentine cooling flow channel, the cooling air CA is introduced from the cooling flow channels of the base portion to the cooling flow channels of the blade shape portion, and the serpentine cooling flow channel is formed of the plurality of systems of the cooling flow channels that are folded back at portions near the platform 12 and the blade top portion 15. As illustrated in the sectional plan view of FIG. 3 in the radial direction, the cooling flow channels, that is, a first cooling flow channel C1 located closest to a leading edge 16 to a seventh cooling flow channel C7 located closest to a trailing edge 17 are arranged in order from the leading edge 16 to the trailing edge 17 in the blade shape portion of the turbine blade. The second cooling flow channel C2 to the seventh cooling flow channel C7 form the plurality of serpentine flow channels including a plurality of fold-back structures. FIG. 3 illustrates the cooling flow channel including the seven flow channels, that is, the first cooling flow channel to the seventh cooling flow channel, but the number of flow channels is not limited to seven.

A thermal stress applied to the fillet portion 14 varies depending on the blade structure and the degree of thermal load put on the blade surface. In general, a thermal stress tends to increase in the fillet portion 14 near the leading edge 16 on a pressure side (positive pressure side) 18 of the blade shape portion 11. In the present embodiment, description is given below mainly of a cooling structure for cooling the fillet portion on the leading-edge pressure side.

Figure 3:
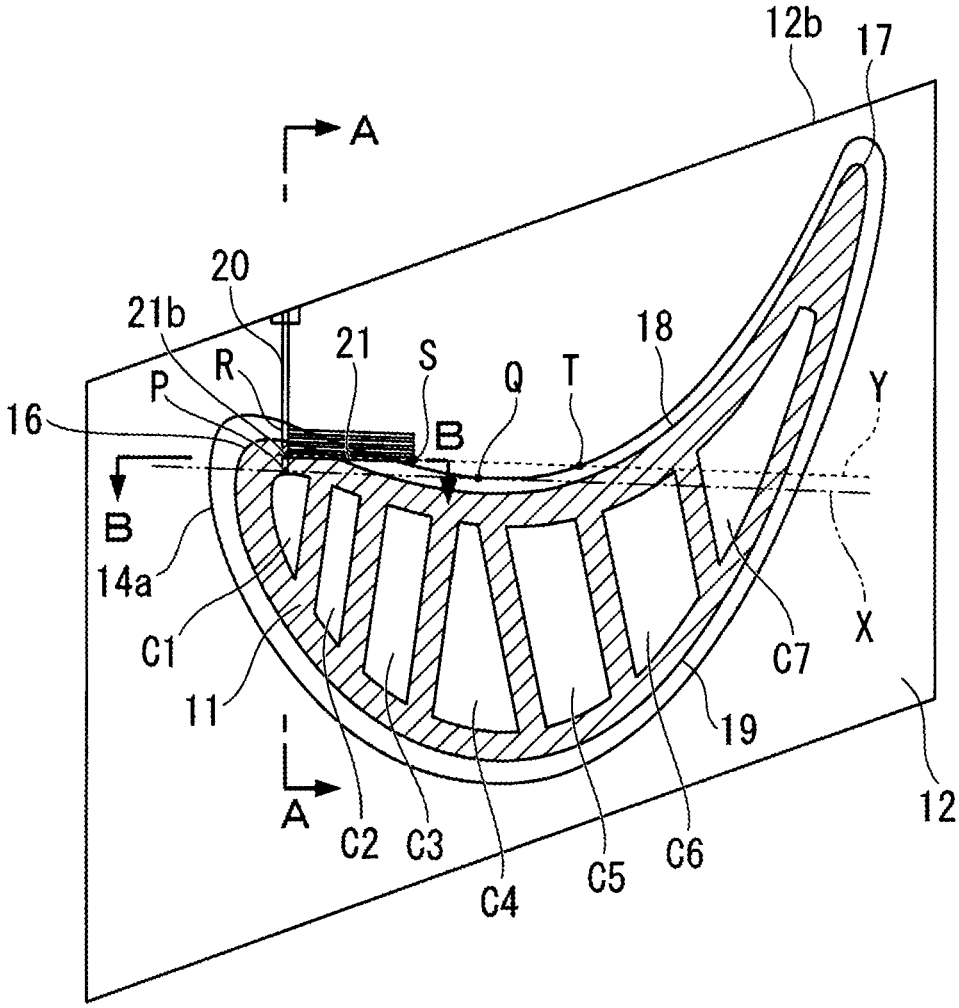
FIG. 3 illustrates a sectional plan view of a turbine blade according to a first embodiment.
Figure 4:
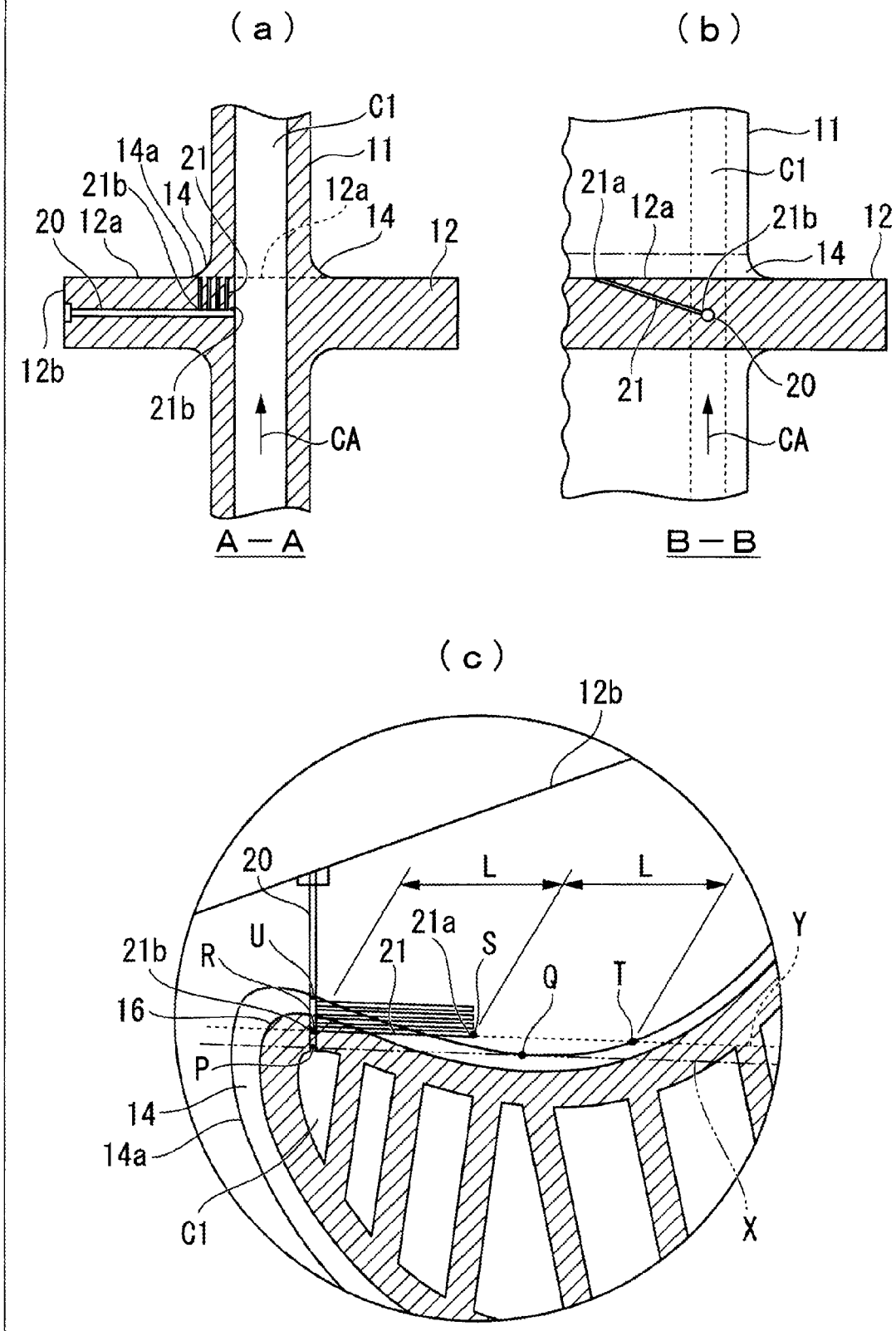
FIG. 4(*a*) illustrates a cross-section A-A of FIG. 3, FIG. 4(*b*) illustrates a cross-section B-B of FIG. 3, and FIG. 4(*c*) illustrates an enlarged sectional plan view around a leading edge of FIG. 3.

In FIG. 3, a reference numeral 19 illustrates a suction side (negative pressure side) of the blade shape portion 11. As illustrated in FIG. 3, the cooling structure near the leading-edge pressure side includes: a main pipe 20 that is drawn from the first cooling flow channel C1 in the platform 12 and has an opening at a side end portion 12*b* of the platform 12 on the pressure side 18 of the blade shape portion 11; and branch pipes 21 each including a film hole 21*a* (see FIG. 4(*c*)) at an end thereof. In the sectional plan view taken in the radial direction of the blade shape portion 11, one end of the main pipe 20 is communicated with the pressure side 18 of the first cooling flow channel C1 provided in the platform 12, the main pipe 20 extends substantially parallel to the surface 12*a* of the platform 12, and another end of the main pipe 20 is opened at the side end portion 12*b* of the platform 12 on the pressure side 18 of the blade shape portion 11, the side end portion 12*b* extending along the rotational axis of the rotor. Note that the opening of the main pipe 20 at the side end portion 12*b* of the platform 12 is blocked with a plug and the like.

As illustrated in FIG. 4(*a*) and FIG. 4(*b*), the plurality of branch pipes 21 each having a diameter smaller than that of the main pipe 20 are branched off from the main pipe 20 so as to be located close to the first cooling flow channel C1. The plurality of branch pipes 21 are arranged parallel to one another at equal intervals from the first cooling flow channel C1 side toward the side end portion 12*b*. In the sectional view taken from the side end portion 12*b* side of the main pipe 20 toward the first cooling flow channel C1, the branch pipes 21 are branched off obliquely outward in the radial direction of the main pipe 20, run along the fillet portion 14 on the pressure side 18 of the blade shape portion 11, and extend substantially linearly toward the trailing edge 17. The branch pipes 21 extend to reach the platform surface 12*a*, and the leading ends of the branch pipes 21 are each opened as a film cooling hole 21*a*.

As illustrated in FIG. 3, FIG. 4(*a*), and FIG. 4(*b*), it is desirable to arrange the branch pipes 21 branched off from the main pipe 20 in the following manner. That is, in the sectional plan view taken in the radial direction of the blade shape portion 11, a plurality of connection ports 21*b* at which the branch pipes 21 are branched off from the main pipe 20 are all arranged inside the sectional plane of the fillet portion 14, and the branch pipes 21 pass just below the fillet portion 14 and extend to the respective film cooling holes 21*a* provided in the platform 12. Here, arranging the connection ports 21*b* inside the sectional plane of the fillet portion 14 means that the connection ports 21*b* between the main pipe 20 and the branch pipes 21 are located inside the outer edge (the boundary line at which the fillet portion 14 is in contact with the platform surface 12*a*) 14*a* of the fillet portion 14 and closer to the first cooling flow channel C1 with respect to the outer edge 14*a* of the fillet portion 14.

Next, the concept of arranging the branch pipes along the fillet portion is described below. In the sectional plan view of the blade shape portion 11 illustrated in FIG. 3 and FIG. 4(*c*), a tangent line is assumed as X, the tangent line externally touching a point P on the inner wall of the pressure side 18 of the first cooling flow channel C1 and internally touching a point Q on the outer edge 14*a* of the fillet portion 14. In addition, the connection port 21*b* between the branch pipe 21 located closest to the first cooling flow channel C1 and the main pipe 20 is assumed as a point R, and a line that passes through the point R and is parallel to the tangent line X is assumed as Y. In this case, the branch pipe having the central axis that coincides with the line Y can be determined as the branch pipe located closest to the fillet portion.

In addition, each branch pipe 21 is formed by hole processing linearly from the opening of the film cooling hole 21*a* toward the main pipe 20. The branch pipe 21 is formed by hole processing such as electric discharge machining or mechanical working, and hence it is necessary to design the length of the branch pipe 21 in consideration of a margin for pulling out a processing tool such as an electrode and a drill. A point closer to the trailing edge 17, of points at which the line Y intersects with the outer edge 14*a* of the fillet portion 14, is assumed as T. In this case, it is desirable to form the branch pipe 21 such that the film cooling hole 21*a* of the branch pipe 21 is located at a middle point S between the point R and the point T or closer to the main pipe 20 with respect to the middle point S.

That is, as illustrated in the enlarged sectional view of FIG. 4(*c*), the film hole 21*a* of the branch pipe 21 is located near the middle point S or closer to the main pipe 20 with respect to the middle point S. For this purpose, on the sectional plane taken in the radial direction of the blade shape portion 11, it is desirable to form each branch pipe such that the length between the points R and S and the length between the points S and T have substantially the same length L or that the length between the points R and S is slightly smaller than the length between the points S and T. If the branch pipes 21 are arranged as described above, the branch pipes 21 can be formed along the fillet portion 14 so as to be closest to the fillet portion 14. Note that, because the blade surface on the pressure side 18 of the blade shape portion 11 is formed by a concave shape, each branch pipe 21, which is extended from the connection port 21*b* of the main pipe 20 on the line Y along the fillet portion 14, passes through inside the sectional plane of the fillet portion 14 (below the fillet portion), crosses the outer edge 14*a* of the fillet portion 14, and forms the film hole 21*a* on the surface 12*a* of the platform 12, in the sectional plan view taken in the radial direction of the blade shape portion 11. The film hole 21*a* is located on the surface 12*a* of the platform 12 so as to avoid a portion thereof on the leading-edge pressure side of the platform 12 to which a high thermal stress is applied, and hence fatigue crack on the platform 12 of the blade due to stress concentration caused by hole processing can be avoided.

In addition, the plurality of branch pipes 21 can be arranged parallel to the above-mentioned branch pipe 21 located closest to the first cooling flow channel C1, between the opened end of the main pipe 20 communicated with the first cooling flow channel C1 and a point U at which the main pipe 20 intersects with the outer edge 14*a* of the fillet portion 14. It is desirable to arrange the plurality of branch pipes 21 parallel to one another and to branch off the branch pipes 21 from the main pipe 20 in the same direction and at the same height in the radial direction. With the branch pipes 21 being arranged as described above, a cooling flow channel can formed of a group of the plurality of branch pipes 21 running along the fillet portion 14, and the fillet portion 14 can be cooled by convection from just below the fillet portion 14 (from the inner side in the radial direction of the fillet portion).

According to the present embodiment, the cooling structure for the fillet portion 14 includes: the main pipe 20 that is drawn from the first cooling flow channel C1 in the blade shape portion 11 and has the opening at the side end portion 12*b* of the platform 12; and the branch pipes 21 that are branched off from the main pipe 20, extend along the fillet portion 14, and each include the film cooling hole 21*a* at the end thereof. Accordingly, the branch pipes 21 can be arranged along the fillet portion 14 so as to be close thereto, and the fillet portion 14 can be cooled by convection from the inner side in the radial direction of the fillet portion 14. In addition, the fillet portion 14 can be cooled by convection without forming hole on the fillet portion 14 and the platform surface 12*a* which is subjected to a high thermal stress, and hence fatigue crack caused by forming a hole on the platform which is subjected to a high thermal stress can be avoided, leading to enhanced reliability of the blade.

In addition, the branch pipes 21 each have the leading end opened on the platform surface 12*a* which is subjected to a relatively low thermal stress, and the film cooling hole 21*a* is formed at this leading end. The film cooling hole 21*a* can have any known suitable shape. Because the branch pipes 21 each include the film cooling hole 21*a* at the end thereof, a stable film layer of cooling air is formed on the platform surface 12*a* by the cooling air CA blown out from the branch pipes 21, and this enables effective film cooling of the platform 12. In addition, because the branch pipes 21 each have the leading end opened on the platform surface 12*a* which is subjected to a small thermal stress, fatigue crack around the film cooling hole 21*a* can be avoided.

Second Embodiment

Hereinafter, a turbine blade and a gas turbine according to a second embodiment are described with reference to FIG. 5(*a*) and FIG. 5(*b*).

Figure 5:
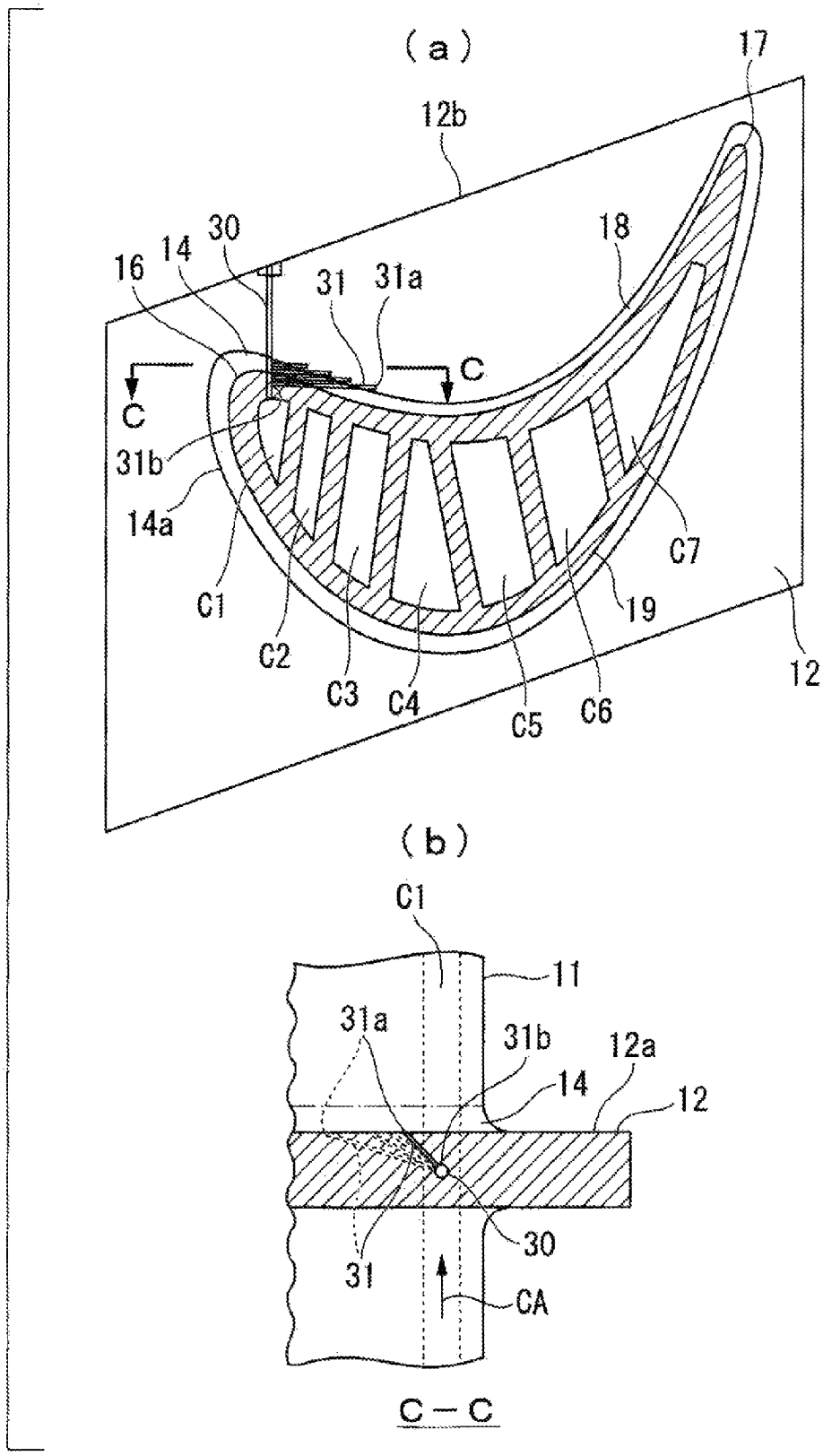
FIG. 5(*a*) illustrates a sectional plan view of a turbine blade according to a second embodiment, and FIG. 5(*b*) illustrates a cross-section C-C of FIG. 5(*a*).

The present embodiment is different from the first embodiment in the arrangement of branch pipes as illustrated in FIG. 5(*a*) and FIG. 5(*b*). Specifically, a branch pipe 31 located closest to the first cooling flow channel C1 is arranged in the same manner as in the first embodiment. That is, in the sectional plan view taken in the radial direction of the blade shape portion 11, a film cooling hole 31*a* of the branch pipe 31 is located at a middle point or closer to a main pipe 30 with respect to the middle point, the middle point being between: a point closer to the trailing edge 17, of points at which the extended line of the branch pipe 31 intersects with the outer edge 14*a* of the fillet portion 14; and a connection port 31*b* with the main pipe 30. The present embodiment is different from the first embodiment in that the lengths of adjacent branch pipes 31 are made smaller with increasing distance from the center of the blade shape portion 11 and that the positions of the film cooling holes 31*a* are sequentially brought closer to the main pipe 30.

As illustrated in FIG. 5(*b*), each branch pipe 31 extends linearly from the main pipe 30 toward the platform surface 12*a* on the trailing edge 17 side, similarly to the first embodiment, and an angle of inclination (an angle to the vertical axis in the radial direction) of each branch pipe is made smaller with increasing distance from the center of the blade shape portion 11 (first cooling flow channel C1). Because the positions of the film cooling holes 31*a* are shifted little by little in the rotor axis direction, a film air layer formed on the platform surface 12*a* is not affected by cooling air blown out from the adjacent branch pipes, and the film layer can be stably maintained. Note that, if the angle of inclination is excessively small, the film layer is difficult to form. In addition, it is difficult to provide the film cooling hole 31*a* of the branch pipe 31 in a portion of the platform to which a high thermal stress is applied, and hence it is not desirable to make the angle of inclination smaller and bring the position of the film cooling hole excessively close to the leading edge.

The concept of arranging the main pipe and the concept of arranging the branch pipes along the fillet portion according to the present embodiment are the same as those of the first embodiment, and the present embodiment can produce an effect similar to that of the first embodiment.

With the cooling structure for the fillet portion according to the present invention, the fillet portion is cooled by convection, and a cooling hole is not required to be formed in a region to which a high thermal stress is applied, so that fatigue crack of the blade can be avoided. Accordingly, the reliability of the blade is enhanced, the gas turbine can be operated for a longer time, and the reliability of the entire gas turbine is enhanced.

In the first embodiment and the second embodiment described above, description is given by taking an example in which the cooling air is taken out from the first cooling flow channel to cool the fillet portion on the leading-edge pressure side, but a similar concept can be applied to even a case where other fillet portion are cooled.

The embodiments described above are given as representative examples reflecting the technical concept of the present invention, and other examples and modified examples can be included within the scope of the present invention as long as those examples satisfy the technical concept of the present invention.

REFERENCE SIGNS LIST

1 gas turbine
2 compressor
3 combustor
4 turbine unit
5 rotor
6 turbine vane
7 turbine blade
11 blade shape portion
12 platform
12*a* platform surface
12*b* side end portion
13 base portion
14 fillet portion
14*a* outer edge of fillet portion
15 blade top portion
16 leading edge

17 trailing edge
18 pressure side (positive pressure side)
19 suction side (negative pressure side)
20, 30 main pipe
21, 31 branch pipe
21*a*, 31*a* film cooling hole
21*b*, 31*b* connection port
C1 first cooling flow channel
C2 to C7 second cooling flow channel to seventh cooling flow channel
CA cooling air

The invention claimed is:

1. A turbine blade comprising:

a base portion fixed to a rotor;

a platform that is fixed to the base portion and includes a cooling flow channel;

a blade shape portion that extends from the platform to an outer side in a radial direction; and a fillet portion provided in a joint surface between the blade shape portion and the platform, the turbine blade further comprising:

a main pipe that is branched off from the cooling flow channel and has an opening at a side end portion of the platform; and a plurality of branch pipes branched off from the main pipe, extend along the fillet portion so as to be closer to the fillet portion on an inner side in the radial direction than the fillet portion on an outer side, and include film cooling holes that open on a surface of the platform, wherein the main pipe is branched off from the cooling flow channel provided closest to a leading edge of the turbine blade, wherein all of the branch pipes extend across the inner side below the fillet portion in the radial direction of the fillet portion, in sectional plan view taken in the radial direction of the blade shape portion, and run along the fillet portion of the blade shape portion, and extend substantially linearly toward the trailing edge.

2. The turbine blade according to claim 1, wherein the branch pipe is provided parallel to a line that is tangent to an inner wall of the cooling flow channel on a pressure side of the blade shape portion and is tangent to an outer edge of the fillet portion on the pressure side of the blade shape portion.

3. The turbine blade according to claim 2, wherein in the sectional plan view taken in the radial direction of the blade shape portion, the branch pipe includes the film cooling hole that is opened at a middle point or closer to the main pipe with respect to the middle point, the middle point being between: an intersection point between an extended line of the branch pipe and the outer edge of the fillet portion; and a connection port with the main pipe.

4. The turbine blade according to claim 2, wherein, in the sectional plan view taken in the radial direction of the blade shape portion, lengths of adjacent branch pipes are made smaller with increasing distance from a center of the blade shape portion, and the film cooling holes of the branch pipes are sequentially brought closer to the main pipe.

5. A gas turbine comprising the turbine blade according to claim 1.

* * * * *